US005121691A

United States Patent [19]

Nicolas

[11] Patent Number: 5,121,691

[45] Date of Patent: Jun. 16, 1992

[54] DESTRUCTIVE EFFECT PROJECTILE THAT EXPLODES ON IMPACT

[75] Inventor: Jacques Nicolas, Morge, France

[73] Assignee: Manurhin Defense, Velizy-Villacoublay Cedex, France

[21] Appl. No.: 730,210

[22] Filed: Jul. 15, 1991

[30] Foreign Application Priority Data

Jul. 17, 1990 [FR] France ..... 90 09111

[51] Int. Cl.[5] ..... F42B 12/44; F42B 12/20;

[52] U.S. Cl. ..... 102/364; 102/205; 102/499; 102/702

[58] Field of Search ..... 102/364, 365, 204, 205, 102/499, 702

[56] References Cited

U.S. PATENT DOCUMENTS

| | | | |
|---|---|---|---|
| 2,323,303 | 7/1943 | Bluehdorn et al. | 102/364 |
| 3,677,181 | 7/1972 | Giljarhus et al. | 102/364 |
| 3,980,020 | 9/1976 | Strandli | 102/364 |
| 3,992,996 | 11/1976 | Strandli | 102/364 |
| 4,167,140 | 9/1979 | Biserod | 102/364 |
| 4,353,302 | 10/1982 | Strandli et al. | 102/364 |
| 4,444,112 | 4/1984 | Strandli et al. | 102/364 |
| 4,480,551 | 11/1984 | LoFiego | 102/245 |

FOREIGN PATENT DOCUMENTS

| | | |
|---|---|---|
| 21658/56 | 9/1979 | Australia . |
| 2067440 | 8/1971 | France . |
| 2229945 | 12/1974 | France . |
| 2229946 | 12/1974 | France . |
| 2533309 | 3/1984 | France . |
| 2606867 | 5/1988 | France . |
| 654406 | 2/1986 | Switzerland . |

OTHER PUBLICATIONS

Abstract of French Patent 2356906, 6-30-77.
Abstract of French Patent 2363076, 8-23-77.
Abstract of Norwegian Patent 137,296, 2-1-76.
Abstract of Norwegian Patent 137735, 5-16-78.

*Primary Examiner*—Harold J. Tudor

[57] ABSTRACT

The invention relates to a projectile comprising a shell body containing an explosive charge and a ballistic nose cone in which a trigger system is disposed. The ballistic nose cone is organized as two distinct parts which are connected together in axial alignment, comprising a bottom portion that is essentially rigid and a top portion that is essentially deformable on impact on a target. Each of the portions is charged with a compressed incendiary composition, and together they form a closed functional cavity whose shape is maintained on firing and during the trajectory of the projectile. The bottom portion also receives a layer of mechanically strong pyrophoric material, said material being set off by the charge in the ballistic nose cone which is itself set off on impact by the sudden increase in the pressure of the air contained in the closed functional cavity. The invention is applicable to making destructive effect projectiles capable of penetrating multiple structures or lightly armored structures with a major incendiary effect and spraying particles of molten metal.

24 Claims, 2 Drawing Sheets

DESTRUCTIVE EFFECT PROJECTILE THAT EXPLODES ON IMPACT

The present invention relates to destructive effect projectiles that explode on impact.

BACKGROUND OF THE INVENTION

Known projectiles, often referred to as multiple effect projectiles, generally comprise a shell body in which an explosive charge is disposed, together with a ballistic nose cone extending said shell body and in which or in the vicinity of which a trigger system is disposed.

Document FR-A-2 229 946 describes a projectile having a delayed explosive effect with an explosive charge that is set off a certain length of time after the moment of impact of said projectile on a target. This delay principle which is well known to persons skilled in the art is implemented by providing an incendiary charge ahead of the explosive charge, with the relatively slow combustion conditions that obtain in the burning mass being used to obtain the delayed explosion. The incendiary charge which is disposed in the body of the shell is thus set off by an incendiary charge disposed in the nose of the projectile or by a fuse. Attempts have thus been made to control the desired delay of the chain of pyrotechnical reactions by providing one or more holes in the incendiary charge disposed in the body of the shell, with said holes increasing the intensity of the combustion of said incendiary charge.

However, such a structure remains of relatively limited application insofar as the delay, which is measured in time corresponding to a distance remains in any event greater than one meter, and insofar as the projectile has mediocre sensitivity to impact, thereby requiring the target to be of considerable thickness for proper use of the projectile. In addition, that prior projectile provides a very low explosive effect with splinters that are large in mass and slow in velocity (the transmission speed of the shock wave is then relatively low). By providing an incendiary composition in the shell body, the amount of room available for the layer of explosive charge is limited.

Document FR-A-2 229 945 describes a variant of the above prior projectile, which variant includes an additional adjustment charge disposed in the shell body above the incendiary charge in said body and associated with a penetration body. However that variant suffers from the same drawbacks and limitations as those mentioned above.

The state of the art is also illustrated by the following documents FR-A-2 067 440, FR-A-2 356 906, FR-A-2 363 076, FR-A-2 533 309, FR-A-2 606 867, U.S. Pat. No. 4,480,551, U.S. Pat. No. 2,323,303, CH-A-654 406, NO-C-137 296, NO-C-137 735, and AU-B-21 658/56.

Those of the above-mentioned documents that describe projectiles having a delayed explosive effect and/or having multiple effects also tend to show that such projectiles suffer from difficulties to a greater or lesser extent in establishing detonation conditions, which conditions become more like deflagration of the explosive charge, thus giving a reduced splintering effect.

An object of the invention is to provide a destructive effect projectile that explodes on impact and that provides better performance than prior art projectiles described in the above-specified patents, with the terminal effect of the projectile being optimized.

Another object of the invention is to provide a projectile that can be used both against armored targets and against targets that are not armored, the projectiles presenting good sensitivity to targets that are not very thick.

Another object of the invention is to provide a projectile having a structure enabling short delays to be obtained, in particular delays of less than one meter, accompanied by a destruction effect that is particularly effective, said effect resulting from a combination of an incendiary effect that is reinforced and considerable penetration power for the fragments generated by the projectile operating on impact (numerous fragments, of low mass and high velocity, thus producing a particularly "explosive" effect) with the shock wave being transmitted at a high velocity.

SUMMARY OF THE INVENTION

More particularly, the present invention provides a destructive effect projectile that explodes on impact, the projectile comprising a shell body in which an explosive charge is disposed, together with a ballistic nose cone extending said shell body and in which a trigger system is disposed, wherein the ballistic nose cone is organized as two distinct portions connected together in axial alignment, namely a bottom portion which is essentially rigid and in the form of a cylindrical can, and a top portion which is essentially deformable on impact on a target and which is in the form of a ballistic nose cone extending the shell body, each of said portions being charged with a compressed incendiary composition having a respective blind axial hollow formed therein in such a manner that said blind hollows together define a closed functional cavity whose shape is maintained on firing and during the trajectory of the projectile, with the bottom portion also receiving a mechanically strong layer of pyrophoric material which is disposed between the perforated bottom of the can and the associated incendiary composition, said pyrophoric material being set off on impact by the charge in the ballistic nose cone due to the sudden local increase in the pressure of the air contained in the closed functional cavity, and then propelling a large number of incandenscent particles at high velocity against the adjacent face of the explosive charge.

Preferably, the bottom portion of the ballistic nose cone is partially received within the top portion of said nose cone, with the remainder of the bottom portion penetrating into the neck of the shell body to provide a connection between said shell body and said nose cone. Advantageously, the bottom and top portions of the ballistic nose cone are interconnected by a screw thread, by crimping, or by gluing.

Also preferably, the bottom portion of the ballistic nose cone and the shell body are connected together by a screw thread, by crimping, or by gluing; in which case, in particular, the bottom portion of the ballistic nose cone may have a bottom edge in contact with a top edge of the neck of the shell body, the respective contacting annular surfaces being preferably disposed conically.

According to another advantageous feature, a mat is interposed between the adjacent faces of the two compressed incendiary compositions constituting the charge of the ballistic nose cone.

There may be a single mat, or in a variant, each of the portions of the ballistic nose cone may have its own mat, in which case the two mats are pressed against each other.

Advantageously, the mat(s) is/are in the form of a pierced or solid disk, with the constituent material of said mat(s) then being a combustible material.

Preferably, the thickness and the constituent material of the top portion of the ballistic nose cone are selected so that said top portion deforms on impact in a manner which simultaneously satisfies the requirements of safety and of sensitivity; in particular, the top portion of the ballistic nose cone may be made of metal, of metal alloy, or of a plastic such as a polyamide.

Also preferably, the thickness and the constituent material of the bottom portion of the ballistic nose cone are selected so that said bottom portion has sufficient rigidity to preserve the setting off sequence on impact; in particular, the bottom portion of the ballistic nose cone is made of metal or of a metal alloy.

According to another advantageous feature, the side wall of each of the blind hollows defining the closed functional cavity is lined, at least in part, by a thin envelope for improving both the mechanical strength of the adjacent compressed composition and the speed with which the charge in the ballistic nose cone is set off; in which case it is preferable for the the thin envelope of each blind hollow to be made of a highly combustible material, e.g. a solid fuel.

Advantageously, the mechanically strong pyrophoric material is based on sponges, and preferably on zirconium sponges; it may be advantageous to provide for the material based on sponges is additionally infiltrated with particles of metal, e.g. of magnesium. In a variant, the mechanically strong pyrophoric material is based on crystals, preferably zirconium in grains.

More generally, it is advantageous for the layer of mechanically strong pyrophoric material to be in the form of a cylindrical pellet whose height is preferably selected to be close to its diameter.

BRIEF DESCRIPTION OF THE DRAWING

An embodiment of the invention is described by way of example with reference to the accompanying drawing, in which.

DETAILED DESCRIPTION

Figure 1:
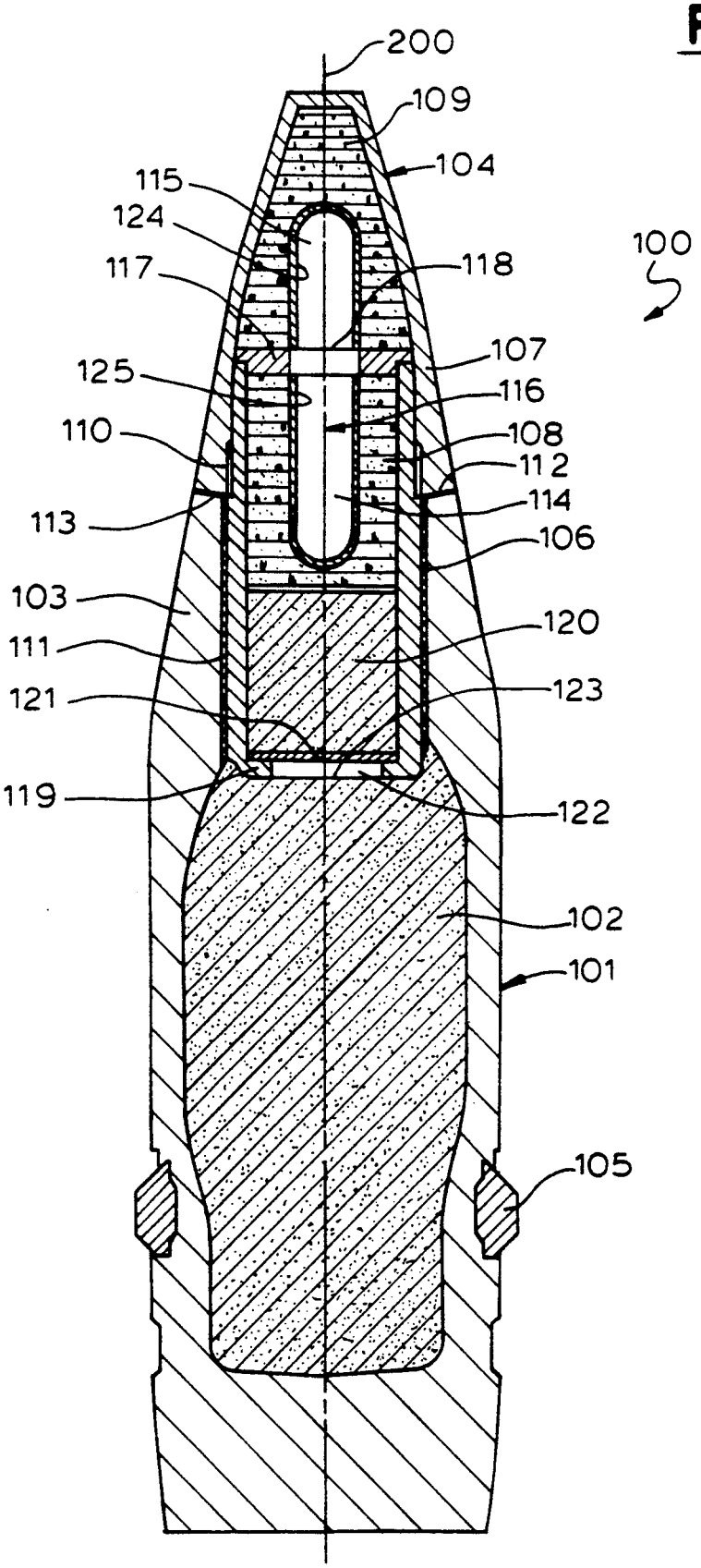
FIG. 1 is an axial section through a destructive effect projectile of the invention that explodes on impact.
Figure 4:
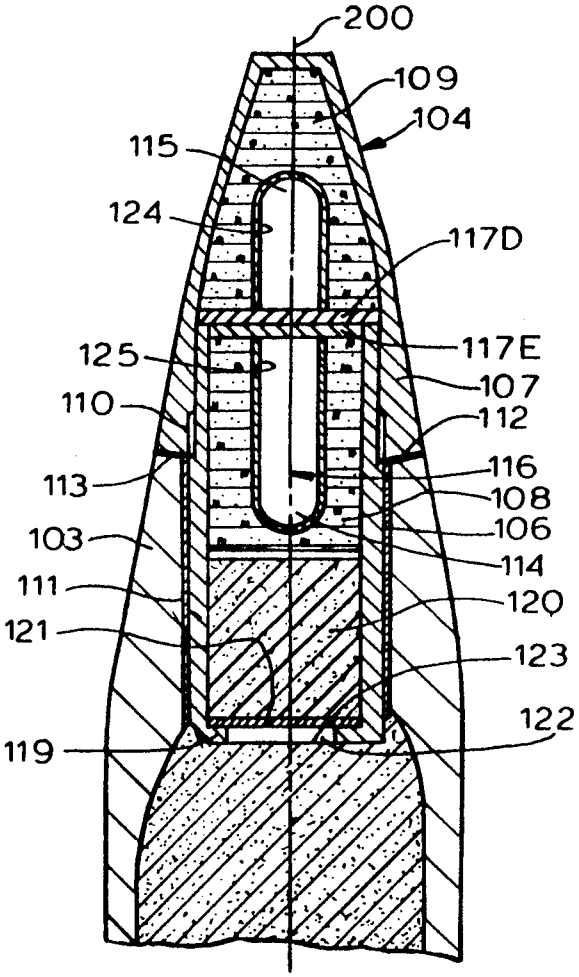
FIGS. 2–4 are each a partially cut away axial section through alternate embodiments of a destructive effect projectile of the invention that explodes on impact. It is understood that other variants could naturally be envisaged within the scope of the invention,. as explained below.
Figure 3:
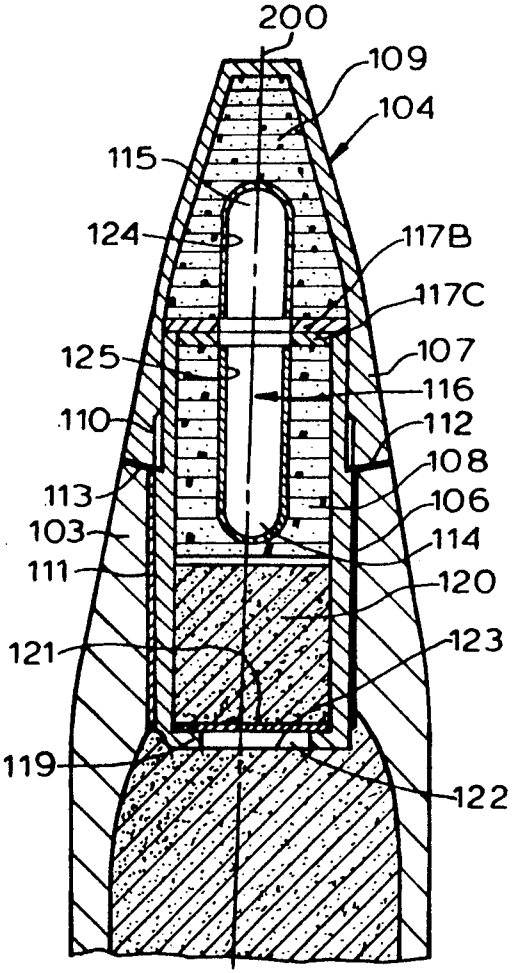

FIG. 1 shows a destructive effect projectile 100 that explodes on impact, comprising a shell body 101 containing an explosive charge 102 and having near its bottom an external guide belt 105, and at its top a ballistic nose cone 104 extending said shell body and containing a trigger system.

In accordance with an essential characteristic of the invention, the ballistic nose cone 104 is organized as two distinct portions 106 and 107 disposed in axial alignment, comprising a bottom portion 106 which is essentially rigid and in the form of a cylindrical can, and a top portion 107 which is essentially deformable by impact on a target and is in the form of a ballistic nose cone extending the shell body 101. Each of these portions 106 and 107 is charged with a compressed incendiary composition 108, 109 with respective blind axial hollows 114 and 115 being formed therein so that together these blind hollows define a closed functional cavity 116 whose shape is maintained during firing and during the flight trajectory of the projectile. The bottom portion 106 also receives a layer of mechanically strong pyrophoric material 120 which is disposed between the pierced bottom of the can 106 and the associated incendiary composition 108, said pyrophoric material being initiated on impact by the combined charges 108 and 109 in the ballistic nose cone 104 when the air contained in the closed functional cavity 116 is suddenly compressed locally, thereby propelling a large number of incandescent particles at high velocity against the adjacent face 123 of the explosive charge 102.

By organizing the ballistic nose cone 104 in two portions in this way it is possible to define a closed functional cavity 116 which lies on the axis 200 of the projectile, said cavity performing an essential function in the operation of said projectile. On impact against a target, the top portion 107 of the ballistic nose cone 104 is deformed suddenly; the composition 109 that it contains then suddenly compresses the air contained in the closed functional cavity 116, and the local pressure rise created in this way sets off the incandescent composition 108 contained in the bottom can-shaped portion 106. In fact, the sudden increase in air pressure has the effect of enhancing mutual friction between the grains of the incandescent composition 108 and 109, as in a lighter. Under these circumstances the combined charges in the ballistic nose cone 104 sets off the mechanically strong pyrophoric material 120 and a large number of incandescent particles are propelled at high speed against the adjacent face of the explosive charge 102.

It should be observed that the closed functional cavity 116 in the ballistic nose cone whose function is to set off the incendiary composition defining it on impact by means of a lighter effect, which composition then sets off the pyrophoric material, has nothing to do with the hole(s) provided in an incendiary charge disposed in the body of a shell (as described in document FR-A-2 229 946, for example) whose sole function is to vary the intensity of the combustion of said incendiary charge.

Each of the component parts of the ballistic nose cone 104 may thus be made separately so that it is easy to choose appropriate compression for the composition disposed in each of its portions, with said compression being chosen in such a manner that the geometry of its blind hollow is maintained during firing and during the flight trajectory of the projectile, such that the side walls of each blind hollow 114 and 115 defining the closed functional cavity 116 are capable of withstanding the forces and stresses applied thereto when the projectile is fired from a barrel, and during the ballistic trajectory of the said projectile.

To make the bottom portion 106 of the ballistic nose cone 104, a cylindrical can having a bottom shoulder 119 defining a coaxial hole 122 is installed, after which a combustible closure mat 121 is put into place with the desired quantity of mechanically strong pyrophoric material being disposed thereon; by exerting high compression on said pyrophoric material, e.g. compression of about two tons, a layer 120 is formed which is in the form of a cylindrical pellet whose height is preferably chosen to be close to its diameter. Thereafter a cylindrical punch (not shown) is disposed on the axis of the can 106 so that the end of the punch is close to the layer 120 of pyrophoric material, and the incendiary composition 108 which may then be subjected to the desired compression, e.g. about one ton, is then installed. After this compression stage, the cylindrical punch which has served as a central core is removed, thereby defining the associated blind axial hollow 114. The mat 117 may then be applied to the top edge of the can 106 so as to facilitate subsequent manipulation of the bottom portion made in this way. By way of example, the volume of the blind axial hollow 114 may be about one-fourth of the inside volume of the can 106.

The can 106 is essentially rigid, i.e. it must remain rigid to conserve the setting off sequence of the shell (initiating the incendiary composition inside the ballistic nose cone, then initiating the mechanically strong pyrophoric material, and finally causing the shell to explode). For example, the can 106 may be made of steel or of a metal alloy (e.g. an aluminum alloy).

The can 106 also has an outside thread 111 at its bottom end enabling it to be screwed into the neck 103 of the shell body 101, together with a top second thread 110 enabling the top portion 107 of the ballistic nose cone 104 to be screwed thereon. However, it should be understood that the connection between the shell body 101 and the bottom portion 106 of the ballistic nose cone 104, and also the connection between the bottom and top portions 106 and 107 of said nose cone could be provided by any other means, e.g. crimping or gluing.

The top portion 107 of the ballistic nose cone 104 has a pointed ballistic shape and it is filled with the composition 109 in the same manner as the bottom portion 106 of said ballistic nose cone. To this end, the same cylindrical punch is used prior to disposing the composition 109 inside the top portion 107 and compressing said composition, thereby defining the blind axial hollow 115 which is to be in axial alignment with the hollow 114 of the bottom portion 106 when the two portions 106 and 107 of the ballistic nose cone 104 are assembled together.

The thickness and the material constituting the top portion 107 of the ballistic nose cone 104 are naturally selected so that said top portion presents satisfactory deformation on impact while simultaneously satisfying requirements relating to safety and sensitivity. The thickness of the top portion of the ballistic nose cone is naturally a function of the caliber in question: in practice, this thickness varies from a few tenths of a millimeter to about one or two millimeters. The material from which it is made may be a metal such as steel, a metal alloy such as an aluminum alloy, or a plastic (e.g. a 6-6 or a 6-12 polyamide), or a plastic alloy which may optionally include a filler.

Finally, it is easy to make the ballistic nose cone 104 by fixing the bottom portion 106 provided with its layer of pyrophoric material 120 and its composition 108 to the top portion 107 provided with its composition 109, and with the ballistic nose cone as assembled in this way then having the closed functional cavity 116 that imprisons a certain volume of air, which volume of air is subsequently subjected to sudden compression on impact against a target because of the deformation of the top portion 107 of the ballistic nose cone 104.

The bottom portion 106 of the ballistic nose cone 104 is thus partially received inside the top portion 107 of the nose cone, with the remainder of said bottom portion penetrating into the neck 103 of the shell body 101 to provide a connection between the shell body and the nose cone. The top portion 107 of the ballistic nose cone 104 then makes contact via its bottom edge 113 with the top edge 112 of the neck 103 of the shell body 101. It is preferable for the respective contacting annular surfaces to be disposed conically, as shown in FIGS. 1–4, so as to improve the behavior of the projectile during its external ballistic trajectory.

Figure 2:
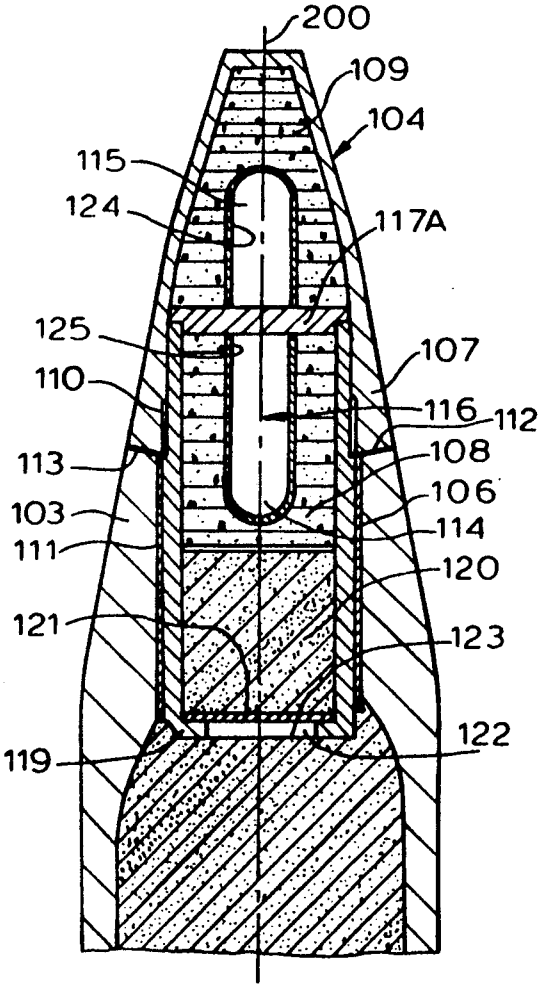

The separation mat 117 is provided on the projectile 100 as shown in FIG. 1, which mat 117 is pierced by a central hole 118. Nevertheless, as shown in FIG. 2, it would also be possible to use a mat 117A that is not pierced, in which case the material from which the mat 117A is made must be combustible. It would also be possible to provide mats 117B and 117C (FIG. 3) or mats 117D and 117E (FIG. 4) associated with each of the portions of the ballistic nose cone 104, with the two mats 117B and 117C or 117D and 117E then being pressed against each other (which mats 117B and 117C may be pierced whereas mats 117D or 117E may not be pierced). It is preferable for the mats 117, 117A, 117B and 117C, and 117D and 117E to be made of a combustible plastic, such as a nitrofilm (e.g. nitrocellulose).

It may also be advantageous to provide for the side wall of each of the blind hollows 114 and 115 defining the closed functional cavity 116 to be lined, as least in part, with a thin envelope 125, 124. Such an envelope then has two advantages insofar as it enhances both the mechanical strength of the adjacent compressed composition 108 or 109, and also the speed with which the assembled charges inside the nose cone 104 are set off. It is preferable to use a thin envelope made of a material that is highly combustible, e.g. a solid propellant. Each of the envelopes 124 and 125 is then separately shaped into the shape of the finger of a glove, and is then installed after the associated blind axial hollow has been formed by removing the cylindrical punch.

The layer 120 of mechanically strong pyrophoric material may be made on the basis of sponges, and in particular zirconium based sponges or crystal based sponges, e.g. sponges based on zirconium grains. The preferred material is more a material based on zirconium sponges possibly with infiltration of metal particles, such as 100 micron to 400 micron particles of magnesium. It would also be possible to use silicon (but this would require a larger volume for the incendiary compositions), or else aluminum (in which case the impact effect would be reduced). Zirconium is thus preferred insofar as it burns very fast, it gives off a large amount of incandescence, and it is very dense, thereby making it possible to obtain a high impact effect. It would also be possible to consider a sintered pyrophoric material instead of a sponge-based material. In any event, the layer of mechanically strong pyrophoric material 120 is accurately held in place by a bottom combustible mat 121 such that there is no risk of any of this material being lost when the ballistic nose cone 104 is installed on the shell body 101.

The incendiary composition 108 or 109 is conventional in type, using barium nitrates, chlorates, alloys of aluminum and of magnesium, and sensitivity-reducing agents. The same applies to the explosive charge 102 of the shell body, which may be made of Tolite, Octonal, Octogen, Hexogen, or Hexal (a mixture of aluminum and Hexogen), etc.

The operation of a projectile 100 in accordance with the invention is now described briefly.

On impact against a target, the top portion 107 of the ballistic nose cone 104 is suddenly deformed, such that the composition 109 disposed in said top portion suddenly compresses the air contained in the closed functional cavity 116, thereby generating very large local excess pressure which gives rise to a lighter effect, thus setting off the incendiary composition 108 contained in the bottom portion 109 of the ballistic nose cone 104. The entire charge in the ballistic nose cone 104 then sets off the mechanically strong pyrophoric material 120 which is preferably based on zirconium sponges. A large number of incandescent particles are then propelled at high speed against the face 123 of the explosive charge 102, passing through the hole 122 provided for this purpose in the bottom of the can 106 (the combustible closure mat 121 being instantly destroyed when the pyrophoric material is set off). The explosive charge 102 then progressively takes up quasi detonating conditions causing the shell to explode and spreading fragments together with a pressure wave, blast, and a splinter effect.

The projectile of the invention is thus particularly sensitive against a target that is not thick, and it provides very high shock wave transmission velocity conditions. It is thus possible to obtain relatively small delays which is measured in time corresponding to a distance, i.e. considerably less than one meter (and which may be reduced in some cases to a few tens of centimeters), with an explosion that is very "explosive" in character, insofar as numerous fragments are obtained of small mass and at high velocities. The projectile thus produces a considerable destructive effect which is the result of an incendiary effect reinforced by high penetration power of the fragments generated by the operation of the projectile on impact. In addition, the simplified architecture of the trigger system of the projectile 100 makes it possible to achieve relatively low manufacturing costs, and in any event costs that are much less than that of an explosive projectile having a mechanical fuse. The system for triggering the explosive charge is thus very simple in architecture, without any mechanical percussion system, no primary explosive, and no trigger relay explosive, thereby making it possible to provide a very high degree of reliability for the behavior of the projectile on impact against a target. The simplified trigger system makes it possible to use a pyrotechnical delay so as to allow the projectile to penetrate multiple structures or structures that are lightly armored. In addition, the trigger system gives rise to a large incendiary effect which is reinforced by particles of molten metal being projected.

The invention is not limited to the embodiment described above but covers any variant that reproduces the essential characteristics of the claims with equivalent means.

I claim:

1. A destructive effect projectile that explodes on impact, the projectile comprising a shell body in which an explosive charge is disposed, a ballistic nose cone extending into said shell body, said ballistic nose cone having a trigger system disposed therein and organized into two distinct portions connected together in axial alignment, one of said portions being a bottom portion which is essentially rigid, is in the form of a cylindrical can and has a perforated bottom, and the other of said portions being a top portion which is essentially deformable on impact on a target and which is in the form of a nose cone extending to the shell body, each of said portions being charged with a compressed incendiary composition having a respective blind axial hollow formed therein in such a manner that said blind hollows together define a closed functional cavity whose shape is maintained on firing and during the trajectory of the projectile, the bottom portion also having a mechanically strong layer of pyrophoric material which is disposed between the perforated bottom and the incendiary composition in the bottom portion, said pyrophoric material being set off on inpact by the charge in the ballistic nose cone due to the sudden local increase in the pressure of air contained in the closed functional cavity such that a large number of incandescent particles are propelled at high velocity against the explosive charge.

2. A projectile according to claim 1, wherein the bottom portion of the ballistic nose cone is partially received within the top portion of said ballistic nose cone, with the remainder of the bottom portion penetrating into a neck of the shell body to provide a connection between said shell body and said ballistic nose cone.

3. A projectile according to claim 2, wherein the bottom portion of the ballistic nose cone has a bottom edge in contact with a top edge of the neck of the shell body, the respective contacting annular surfaces being disposed conically with respect to each other.

4. A projectile according to claim 1, wherein the bottom and top portions of the ballistic nose cone are interconnected by one of the following: a screw thread, crimping, or gluing.

5. A projectile according to claim 1, wherein the bottom portion of the ballistic nose cone and the shell body are connected together by one of the following: a screw thread, crimping, or gluing.

6. A projectile according to claim 1, wherein a mat is interposed between adjacent facing surfaces of the two compressed incendiary compositions constituting the charge of the ballistic nose cone.

7. A projectile according to claim 6, wherein each of the portions of the ballistic nose cone has its own mat, the two mats being pressed against each other.

8. A projectile according to claim 6, wherein the mat is in the form of a pierced disk, with the constituent material of said mat then being a combustible material.

9. A projectile according to claim 6, wherein the mat is in the form of a solid disk, with the constituent material of said mat being a combustible material.

10. A projectile according to claim 1, wherein the top portion of the ballistic nose cone is made of a deformable material that deforms on impact.

11. A projectile according to claim 10, wherein the top portion of the ballistic nose cone is made of one of following: a metal, a metal alloy, and a plastic.

12. A projectile according to claim 11, wherein said plastic is a polyamide.

13. A projectile according to claim 1, wherein the bottom portion of the ballistic nose cone is made of a relatively rigid material.

14. A projectile according to claim 13, wherein the botton portion of the ballistic nose cone is made of one of the following: a metal and a metal alloy.

15. A projectile according to claim 1, wherein the side walls of each of the blind hollows defining the closed functional cavity is at least partially by a thin envelope for improving both the mechanical strength of the adjacent compressed composition and the speed with which the charge in the ballistic nose cone is set off.

16. A projectile according to claim 15, wherein the thin envelope of each blind hollow is made of a highly combustible material.

17. A projectile according to claim 16, wherein said highly combustible material is a solid fuel.

18. A projectile according to claim 1, wherein the mechanically strong pyrophoric material is based on sponges.

19. A projectile according to claim 18, wherein the material based on sponges is additionally infiltrated with particles of metal.

20. A projectile according to claim 19, wherein said particles of metal are made of magnesium.

21. A projectile according to claim 18, wherein the layer of mechanically strong pyrophoric material is in the form of a cylindrical pellet whose height is selected to be close to its diameter.

22. A projectile according to claim 18, wherein said sponges are zirconium sponges.

23. A projectile according to claim 1, wherein the mechanically strong pyrophoric material is based on crystals.

24. A projectile according to claim 23, wherein said crystals are zirconium in grains.

* * * * *